US010982373B2

(12) United States Patent
Cooke et al.

(10) Patent No.: US 10,982,373 B2
(45) Date of Patent: Apr. 20, 2021

(54) LAUNDRY LIQUID MIXING APPARATUS

(71) Applicant: Conopco, Inc., Englewood Cliffs, NJ (US)

(72) Inventors: Deborah Jane Cooke, Chester (GB); David Moorfield, Buckley (GB); Katharine Jane Shaw, Wirral (GB)

(73) Assignee: Conopco, Inc., Englewood Cliffs, NJ (US)

( * ) Notice: Subject to any disclaimer, the term of this patent is extended or adjusted under 35 U.S.C. 154(b) by 0 days.

(21) Appl. No.: 16/306,057

(22) PCT Filed: Jun. 1, 2017

(86) PCT No.: PCT/EP2017/063403
§ 371 (c)(1),
(2) Date: Nov. 30, 2018

(87) PCT Pub. No.: WO2017/211699
PCT Pub. Date: Dec. 14, 2017

(65) Prior Publication Data

US 2019/0292710 A1 Sep. 26, 2019

(30) Foreign Application Priority Data

Jun. 9, 2016 (EP) ..... 16173792

(51) Int. Cl.
*D06F 39/02* (2006.01)
*B01F 13/10* (2006.01)
(Continued)

(52) U.S. Cl.
CPC ..... *D06F 39/022* (2013.01); *B01F 13/1066* (2013.01); *C11D 3/386* (2013.01);
(Continued)

(58) Field of Classification Search
CPC .. D06F 39/022; D06F 39/024; B01F 13/1066; B01F 2215/0077; C11D 3/386;
(Continued)

(56) References Cited

U.S. PATENT DOCUMENTS 3,094,247 A * 6/1963 Marchi ..... G01F 11/08 222/54
4,932,227 A 6/1990 Hogrefe
(Continued)

FOREIGN PATENT DOCUMENTS

AU 13548 9/1988
CN 1387563 12/2002
(Continued)

OTHER PUBLICATIONS

Search Report and Written Opinion in PCTPE2019054368; dated Apr. 23, 2019.
(Continued)

*Primary Examiner* — Nicolas A Arnett
(74) *Attorney, Agent, or Firm* — Greenberg Traurig, LLP

(57) ABSTRACT

Apparatus for providing a laundry product to a wash load based on user input, comprising a dosing unit (2) for placing in a washing machine drum and a dispensing device (1) having a dispensing area (3), a nozzle (4) and a plurality of reservoir cartridges (6*a*, 6*b*, 6*c*) containing various laundry products that are combined by a user and which are dispensed into the dosing unit (2) by said nozzle (4) as soon as said dosing unit (2) is placed in the dispensing area (3) located underneath the nozzle (4).

11 Claims, 2 Drawing Sheets

(51) Int. Cl.

| | |
|---|---|
| ***C11D 3/386*** | (2006.01) |
| ***C11D 3/40*** | (2006.01) |
| ***C11D 3/48*** | (2006.01) |
| ***C11D 11/00*** | (2006.01) |

(52) U.S. Cl.

CPC ..... *C11D 3/38645* (2013.01); *C11D 3/40* (2013.01); *C11D 3/48* (2013.01); *C11D 11/0017* (2013.01); *D06F 39/024* (2013.01); *B01F 2215/0077* (2013.01)

(58) Field of Classification Search

CPC ..... C11D 3/38645; C11D 3/40; C11D 3/48; C11D 11/0017

See application file for complete search history.

(56) References Cited

U.S. PATENT DOCUMENTS

| | | | | |
|---|---|---|---|---|
| 5,897,671 | A | 4/1999 | Newman et al. | |
| 6,349,440 | B1 * | 2/2002 | Amberg | D06F 39/022 8/158 |
| 8,631,972 | B2 | 1/2014 | Kessler et al. | |
| 9,469,933 | B2 * | 10/2016 | Miller | G05B 19/0428 |
| 9,949,612 | B2 | 4/2018 | Lonski | |
| 10,240,274 | B2 * | 3/2019 | Miller | D06F 33/00 |
| 2001/0049846 | A1 | 12/2001 | Guzzi et al. | |
| 2002/0077265 | A1 | 6/2002 | Buzzacarini et al. | |
| 2003/0075237 | A1 | 4/2003 | Bettiol et al. | |
| 2003/0154560 | A1 | 8/2003 | Behrens et al. | |
| 2003/0216274 | A1 | 11/2003 | Del Duca et al. | |
| 2004/0147416 | A1 | 7/2004 | Woo et al. | |
| 2005/0033647 | A1 | 2/2005 | Crisp, III | |
| 2005/0102767 | A1 | 5/2005 | Aouad et al. | |
| 2005/0106192 | A1 | 5/2005 | Parekh et al. | |
| 2006/0102656 | A1 | 5/2006 | Troost et al. | |
| 2006/0138169 | A1 | 6/2006 | Cafferty | |
| 2006/0272360 | A1 | 12/2006 | Hsu et al. | |
| 2007/0044820 | A1 | 3/2007 | Chan et al. | |
| 2008/0276655 | A1 | 11/2008 | Luckman et al. | |
| 2008/0276964 | A1 | 11/2008 | Hendrickson et al. | |
| 2008/0276965 | A1 | 11/2008 | Aykroyd et al. | |
| 2009/0044129 | A1 | 2/2009 | Ebrom et al. | |
| 2009/0044137 | A1 | 2/2009 | Bartley et al. | |
| 2009/0194562 | A1 | 8/2009 | Kessler et al. | |
| 2009/0276101 | A1 | 11/2009 | Yankee et al. | |
| 2010/0102076 | A1 | 4/2010 | Hendrickson et al. | |
| 2010/0102082 | A1 | 4/2010 | Ebrom et al. | |
| 2010/0163573 | A1 | 7/2010 | Wegelin et al. | |
| 2011/0139818 | A1 | 6/2011 | Kessler et al. | |
| 2011/0154864 | A1 | 6/2011 | Schulze | |
| 2011/0174346 | A1 | 7/2011 | Kessler et al. | |
| 2011/0290281 | A1 | 12/2011 | Kessler et al. | |
| 2011/0315709 | A1 | 12/2011 | Fileccia et al. | |
| 2012/0015858 | A1 | 1/2012 | Kessler et al. | |
| 2012/0018451 | A1 | 1/2012 | Fileccia | |
| 2012/0021965 | A1 | 1/2012 | Bastigkeit et al. | |
| 2012/0031930 | A1 | 2/2012 | Feliccia et al. | |
| 2012/0056827 | A1 | 3/2012 | Kim et al. | |
| 2012/0088710 | A1 | 4/2012 | Kessler et al. | |
| 2012/0204356 | A1 | 8/2012 | Bastigkeit et al. | |
| 2012/0247158 | A1 | 10/2012 | Ditze et al. | |
| 2012/0088709 | A1 | 12/2012 | Kessler et al. | |
| 2013/0036775 | A1 | 2/2013 | Brueckner et al. | |
| 2013/0042652 | A1 | 2/2013 | Brueckner et al. | |
| 2013/0061404 | A1 | 3/2013 | Jenkins | |
| 2013/0175293 | A1 | 7/2013 | Burgess | |
| 2013/0263630 | A1 | 10/2013 | Doh et al. | |
| 2013/0340178 | A1 | 12/2013 | Riesenberg et al. | |
| 2014/0102153 | A1 | 4/2014 | Lee et al. | |
| 2015/0330013 | A1 | 11/2015 | Miller | |
| 2015/0368846 | A1 | 12/2015 | Del Pos et al. | |
| 2015/0375900 | A1 | 12/2015 | Larson | |
| 2016/0060800 | A1 | 3/2016 | Ghosh et al. | |
| 2016/0289883 | A1 | 10/2016 | Lv et al. | |
| 2017/0081616 | A1 | 3/2017 | Baltsen et al. | |
| 2017/0107658 | A1 | 4/2017 | Bolton et al. | |
| 2017/0292217 | A1 | 10/2017 | Kulkarni | |
| 2018/0171531 | A1 * | 6/2018 | Miller | D06F 34/28 |
| 2019/0136162 | A1 * | 5/2019 | Cooke | D06F 39/02 |

FOREIGN PATENT DOCUMENTS

| | | |
|---|---|---|
| CN | 1401030 | 3/2003 |
| CN | 101886323 | 11/2010 |
| CN | 101886324 | 11/2010 |
| CN | 102571129 | 7/2012 |
| CN | 202744828 | 2/2013 |
| CN | 103485122 | 1/2014 |
| CN | 103726273 | 4/2014 |
| CN | 103924415 | 7/2014 |
| CN | 204211975 | 3/2015 |
| CN | 104652098 | 5/2015 |
| CN | 105143543 | 12/2015 |
| CN | 205258897 | 5/2016 |
| CN | 106192308 | 12/2016 |
| DE | 744406 | 1/1944 |
| DE | 102007041643 | 3/2009 |
| DE | 102008047941 | 3/2010 |
| DE | 102008053312 | 4/2010 |
| DE | 10201003776 | 10/2011 |
| DE | 102010027991 | 10/2011 |
| DE | 102010028353 | 11/2011 |
| DE | 102010027993 | 5/2012 |
| DE | 102013018175 | 6/2015 |
| DE | 102016212981 | 1/2018 |
| DE | 102016212982 | 1/2018 |
| EP | 0368680 | 5/1990 |
| EP | 1041187 | 10/2000 |
| EP | 1088927 | 4/2001 |
| EP | 1317524 | 6/2003 |
| EP | 1318225 | 6/2003 |
| EP | 1468926 | 10/2004 |
| EP | 1212398 | 6/2006 |
| EP | 1728912 | 6/2006 |
| EP | 1990461 | 11/2008 |
| EP | 1995368 | 11/2008 |
| EP | 2065860 | 6/2009 |
| EP | 2141275 | 1/2010 |
| EP | 2314542 | 4/2011 |
| EP | 2642013 | 9/2013 |
| EP | 2913431 | 9/2015 |
| EP | 2939975 | 11/2015 |
| EP | 2955150 | 12/2015 |
| EP | 3130968 | 2/2017 |
| EP | 3176298 | 6/2017 |
| FR | 2612894 | 9/1988 |
| GB | 2437555 | 9/2008 |
| GB | 2468158 | 9/2010 |
| GB | 2581486 | 4/2013 |
| GB | WO2017205280 | 11/2017 |
| KR | 20100081221 | 7/2010 |
| WO | WO9115623 | 10/1991 |
| WO | WO0196645 | 12/2001 |
| WO | WO0208371 | 1/2002 |
| WO | WO0220893 | 3/2002 |
| WO | WO2004101122 | 11/2004 |
| WO | WO2008008392 | 1/2008 |
| WO | WO2008016683 | 2/2008 |
| WO | WO2008074680 | 6/2008 |
| WO | WO2009022223 | 2/2009 |
| WO | WO2009033828 | 3/2009 |
| WO | WO2009094999 | 8/2009 |
| WO | WO2009095003 | 8/2009 |
| WO | WO2009117795 | 10/2009 |
| WO | WO2009153184 | 12/2009 |
| WO | WO2010007054 | 1/2010 |
| WO | WO2010031607 | 3/2010 |
| WO | WO2010067303 | 6/2010 |
| WO | WO2011042867 | 4/2011 |
| WO | 102009046546 | 5/2011 |
| WO | WO2011128676 | 10/2011 |
| WO | WO2011131256 | 10/2011 |
| WO | WO2011134690 | 11/2011 |
| WO | WO2011138218 | 11/2011 |

(56) References Cited

FOREIGN PATENT DOCUMENTS

| | | |
|---|---|---|
| WO | WO2012084005 | 6/2012 |
| WO | WO2012118285 | 9/2012 |
| WO | WO2013054089 | 4/2013 |
| WO | WO2014031753 | 2/2014 |
| WO | WO2014079621 | 5/2014 |
| WO | WO2016173679 | 11/2016 |
| WO | WO2017042087 | 3/2017 |
| WO | WO2017067936 | 4/2017 |
| WO | WO2017176292 | 10/2017 |
| WO | WO2017211698 | 12/2017 |
| WO | WO2017211700 | 12/2017 |
| WO | WO2017211701 | 12/2017 |
| WO | WO2018011167 | 1/2018 |
| WO | WO2018011179 | 1/2018 |

OTHER PUBLICATIONS

Search Report and Written Opinion in PCTEP2019052152; dated Mar. 29, 2019.
Search Report and Written Opinion in PCTEP2019054369; dated Apr. 23, 2019; .
Written Opinion 2 in PCTEP2018075459; dated Aug. 26, 2019.
IPRP2 in PCTEP2018075452; dated Jan. 10, 2020; .
Written Opinion 2 in PCTEP2019054368.; dated Jan. 24, 2020.
Search Report and Written Opinion in PCTEP2018076486; dated Nov. 6, 2018.
Search Report and Written Opinion in PCTEP2018075459; dated Nov. 27, 2018.
Search Report and Written Opinion in PCTEP2018075439; dated Nov. 27, 2018.
Search Report and Written Opinion in EP17206467; dated Jun. 19, 2018.
Search Report and Written opinion in EP18155012; dated Jul. 13, 2018.
Search Report and Written Opinion in PCTEP2017072935; dated Nov. 16, 2017.
Search Report and Written Opinion in EP17194249; dated Mar. 26, 2018.
Search Report and Written Opinion in EP17194986; dated Apr. 19, 2018.
Search Report and Written Opinion in EP17194201; dated Mar. 9, 2018.
Search Report and Written Opinion in EP16193266; dated Mar. 29, 2017.
Written Opinion 2 in PCTEP2018050562; dated Jan. 10, 2019.
Search Report and Written Opinion in PCTEP2018075452; dated Jan. 2, 2019.
Search Report and Written Opinion in PCTEP2018076258; dated Nov. 6, 2018.
Search Report and Written Opinion in EP18162886; dated Sep. 4, 2018.
Co-Pending Application; entitled Provision of Laundry Product; filed Nov. 29, 2018.
Co-Pending Application; entitled Laundry Products; filed Nov. 29, 2018.
Search Report and Written Opinion in PCTEP2019052151; dated Mar. 29, 2019.
IPRP2 in PCTEP2019050562; dated May 15, 2019.
Search Report in Application No. GB1803058.5; dated Mar. 11, 2019.
IPRP2 in PCTEP2017063403; dated Aug. 10, 2018.
Search Report and Written Opinion in PCTEP2017063403; dated Aug. 23, 2017.
Search Report and Written Opinion in EP16173798; dated Nov. 24, 2016.
Search Report and Written Opinion in EP16173811; dated Nov. 28, 2016.
Search Report and Written Opinion in EP16173806; dated Dec. 19, 2016.
Search Report and Written Opinion in EP16173793; dated Dec. 9, 2016.
Search Report and Written Opinion in PCTEP2017063402; dated Sep. 4, 2017.
Search Report and Written Opinion in PCTEP2017063401; dated Aug. 31, 2017.
Search Report & Written Opinion in PCTEP2017063404; dated Aug. 3, 2017.
Written Opinion in PCTEP2017063405; dated May 17, 2018; World Intellectual Property Org. (WIPO).
Written Opinion 2 in PCTEP2017063404; dated Apr. 18, 2018.
IPRP2 in PCTEP2017063405; dated Sep. 17, 2018.
IPRP in PCTEP2017063402; dated Sep. 24, 2018.
Written Opinion 3 in PCTEP2017063404; dated Aug. 16, 2018.
Search Report and Written Opinion in PCTEP2018050562; dated May 11, 2018; Partial Search Report.
Search Report 2 and Written Opinion 2 in PCTEP2018050562; Jul. 4, 2018; World Intellectual Property Org. (WIPO).
IPRP2 in PCTEP2017063401; dated Jul. 23, 2018.
Search Report and Written Opinion in PCTEP2017063405; dated Jul. 25, 2017.
Search Report and Written Opinion in EP17152439; dated Jul. 17, 2017.
IPRP in PCTEP2017063404; dated Oct. 10, 2018.
Written Opinion for PCTEP2018075452; dated Sep. 19, 2019.
Spruce App; Spruce App; 2019; pp. 1-12 (https://www.thespruce.com/there-is-an-app-for-laundry-2146366).
Clorox My Stain App; Clorox My Stain App; 2020; pp. 1-3 https://play.google.com/store/apps/details?id=net.clorox2.mystain&hl=en_US.
Apps for Dry Clearners; Apps for Dry Cleaners; 2020; pp. 1-2, dlionline.org/apps.
VeryWear App STAIN; VeryWear App STAIN; 2020; pp. 1-4, https://appadvice.com/app/the-stain/510901231.
AEG, My AEG Care App; AEG, My AEG Care App; 2020; pp. 1-10, https://www.aeg.co.uk/about-aeg/connectivity-hub/#732729.
Hoover, Hoover Wizard App; Hoover, Hoover Wizard App; 2020; pp. 1-6, http://www.hooveronetouch.com/gb/index.html.
Candy Smart Touch App; Candy Smart Touch App; 2020; http://www.candysmarttouch.com/eu/index.html.
Samsung, SmartThings Classic App; Samsung, SmartThings Classic App; 2020; https://play.google.com/store/apps/details?id=com.smartthings.android&hl=en.
IPRP2 in PCTEP2019054368; Jun. 23, 2020.

* cited by examiner

LAUNDRY LIQUID MIXING APPARATUS

The present invention relates to devices for providing laundry compositions on demand in a user's home.

For many consumers, no one laundry product fulfils all of their needs. As a result, many consumers buy and store more than one laundry product. Selections include biological and non-biological products, products specifically formulated for white or colours or wools/silk. In addition to storing these laundry products, consumers often store one or more additional stain removal products and/or benefit agents. In total, this can amount to a relatively large number of bottles/boxes stored in consumers' kitchens, utility rooms, garages or basements.

Other consumers simply use one laundry product for all loads, regardless of suitability. This can mean that unnecessary enzymes, bleaches etc are used in so-called refresh washes (where the load is not stained) which may have detrimental effects on fabric care and/or the environment.

The present invention seeks to address one or more of these problem identified in the prior art.

SUMMARY

The invention relates to a device for dispensing laundry product into a dosing unit. Suitably, the dosing unit may then be placed in the washing machine drum as normal for the wash program. The dispensing device prepares laundry product according to a recipe. The recipe may be selected based on the user's needs/preferences.

The laundry product is prepared from one or more reservoirs. The reservoirs contain laundry ingredient compositions, which may be liquid or solid (e.g. powder). For example, a first reservoir may comprise a "base" detergent composition, while a further reservoir may comprise an optional ingredient composition. Optional ingredients may include, without limitation, enzymes, bleaches, disinfectant, and fragrance. It will be appreciated that preferably there is more than one further reservoir, permitting more variety in laundry product dosing. The device provides, on command, composition from the first reservoir and optionally one or more of the further reservoirs, thereby providing a laundry product that may be considered bespoke to the user's particular wants and needs. For example, the product may be prepared to target particular stains, obviating the need for specific spot treatment.

An additional or alternative benefit of the present invention is that laundry product ingredient combinations not normally accessible in a single product may be generated by the device. As the time period between dosing the product and beginning the wash is small, problems associated ingredient incompatibility and degradation are avoided.

This is especially true of liquid compositions, in which ingredients are more readily able to react on storage. Similarly, as composition is dosed directly into the dosing unit to a recipe stored within or generated by the device, it is not necessary that the final composition be substantially homogenous or of a particular viscosity, as is normally the case for commercially supplied laundry liquid products. This permits greater flexibility in the identity of, and relative ratios of, various ingredients.

In a first aspect, the invention relates to an apparatus for providing laundry product bespoke to a wash load based on user input, the apparatus comprising a dosing unit for placing in a washing machine drum and a dispensing device having a plurality of reservoirs containing various ingredients that are combined based on the user's input.

Accordingly, in a first aspect, the present invention may provide an apparatus for providing laundry product, the apparatus comprising a dosing unit for placing in a washing machine drum and a dispensing device having a first reservoir containing a detergent composition and a further reservoir containing an ingredient composition; wherein the device has a computer module programmed to cause the device to dispense the detergent composition and optionally the ingredient composition to provide a laundry product in the dosing device as a result of input by a user.

The dosing unit may be conventional dosing ball, or may have one or more features designed to complement or otherwise interact with the device. In some cases, the dosing unit seals the product within a chamber inside the unit, opening during the wash cycle to form a wash liquor.

The composition is dispensed by the computer module according to input provided by the user. Input may be provided in various ways, for example by the user making choices or providing suggestions, or through sensing a tag or label in the article to be laundered (such as a QR "quick response" code). Suitably, this input is captured via a user interface on the device. The device may include a graphical user interface (GUI). For example, the GUI may be presented to the user on a digital screen of the user interface. Input from the user may be captured by the user interface of the device via various user interaction mechanisms including: manipulation of buttons, touch screen, voice commands, gestures or other suitable methods. The computer module may communicate with an external user device such as a mobile phone, tablet or laptop to receive user inputs from a user interface on the external device. Using the interface, the user may select a suitable laundry liquid recipe, or the computer module may select, generate or obtain a recipe based on the input (load type, staining, preferences and previous wash history etc). The recipe used to determine the amounts may be obtained from an internal memory within the device, or may be obtained from an external memory accessed, for example, via the internet.

The user interface may include a facility to input data in sets, for example through asking to user to selection certain options or alternatives. Accordingly, the device may have or communicate with a user interface via which the user is able to input data using at least two sets of options.

At least one set of options may prompt the user to input stain identity (grass, chocolate, blood etc).

At least one set of options prompts the user to input fabric colour and/or type. (e.g. cotton, polycotton, polyester).

Based on the data provided for each of these sets, an algorithm may be employed to determine an optimised formulation, balancing the cleaning needs of certain stains against others. The algorithm may be stored and accessed on the computer module of the device, or it may be obtained from an external source such as the internet.

Accordingly, in some cases the computer module is programmed with an algorithm to determine how much product is dosed from each reservoir based on the user input.

Accordingly, in some cases the computer module is programmed to communicate with an external source to access an algorithm and determine how much product is dosed from each reservoir based on the user input.

Each reservoir is in controllable fluid communication with a dispensing nozzle which dispenses into the dosing unit. The compositions from the various reservoirs may be dispensed directly into the dosing unit (as it is not necessary that the various compositions are mixed before use) or may be dispensed via a pre-mixing chamber, which mixes two or more compositions prior to dispensing.

In some cases, the compositions are dispensed directly into the dosing unit. They may be dosed sequentially or concurrently.

In some cases, the device has a pre-mixing chamber in which two or more compositions are mixed prior to dispensing. Individual ingredient compositions may be dispensed into said chamber, where they may be mechanically mixed (by stirring or agitation, for example), or may naturally disperse and mix as each component is added.

For example, and not by way of limitation, the ingredient composition may be an enzyme composition. The user may then select a "biological" or "non-biological" wash, depending on whether or not enzyme is dispensed.

Accordingly, in some cases the device has a further reservoir containing a composition comprising an enzyme.

For example, and not by way of limitation, the ingredient composition may be a whitening composition (for example, containing one or more whiteners, fluorescent compounds, shading dye). The user may select a "whites" or "colours" wash, depending on whether or not whitening composition is dispensed.

Accordingly, in some cases the device has a further reservoir containing a composition comprising a fluorescer and/or a shading dye.

It will be appreciated that preferably the device comprises more than one further reservoir. This permits greater variation in the laundry liquid compositions obtainable from the device.

For example, with one further reservoir, two types of composition are obtainable: Base composition and Base composition+ingredient 1.

With two further reservoirs, four types of compositions are obtainable: Base composition; Base composition+ingredient 1; Base composition+ingredient 2 and Base composition+ingredient 1+ingredient 2.

With three further reservoirs, eight types of compositions are obtainable: Base composition; Base composition+ingredient 1; Base composition+ingredient 2; Base composition+ingredient 3; Base composition+ingredient 1+ingredient 2; Base composition+ingredient 1+ingredient 3, Base composition+ingredient 2+ingredient 3 and Base composition+ingredient 1+ingredient 2+ingredient 3.

In some embodiments, the device has only one further reservoir. In some embodiments, the device has two or more further reservoirs. In some embodiments, the device has three or more further reservoirs. In some embodiments, the device has four or more further reservoirs. In some embodiments, the device has five or more further reservoirs. It will be understood that, while there is no upper limit, for simplicity it is likely that no more than eight, optionally no more than seven, optionally no more than six further reservoirs are present.

The reservoirs may be integral to the housing of the device or, more preferably, they may be provided as prefilled cartridges that cooperate with the housing of the device, such that the composition in the reservoir is in fluid communication with a nozzle for dispensing the composition into the dosing unit or a pre-mixing chamber.

A reservoir cartridge may have stiff walls. In other words, the cartridge may retain its shape regardless of the amount of laundry product in the reservoir. A reservoir cartridge may have flexible walls. It will be appreciated that the cartridge may be configured to suit the overall design and shape of the device. Said reservoir cartridge may be, without limitation, a pouch or stiff plastic container.

Each reservoir cartridge may be fixable within the device such that the contents of the reservoir are sealable by a valve. Suitably, therefore, the cartridge comprises mating means configured to engage with complementary mating means on the device such that, when in place, the reservoir cartridge is held securely and laundry product within the reservoir cartridge is contained or released according to whether the valve of the device is in a closed or open state. In other words, the cartridge may comprise a connecting portion which mates with a complementary connection portion of the device.

Additionally or alternatively, the contents of the reservoir may be supplied by pressure and/or vacuum generated within the device. It will be appreciated that the device may have a pump to move the liquids from the reservoirs to the dosing nozzle, optionally via a pre-mixing chamber, to be dispensed.

Accordingly, each reservoir cartridge may be fixable to the device by mating means configured to engage with complementary mating means on the device such that, when in place, the reservoir cartridge is held securely and laundry product within the reservoir cartridge is contained or released according to whether the pump is on or off.

In some embodiments, the device may comprise a further reservoir containing an ingredient composition comprising a disinfectant. This may be optionally dosed for a hygiene wash, for example when a member of the household has been ill or for fabric stained with bodily fluids or biological waste. Additionally or alternatively, the device may comprise a further reservoir containing an ingredient composition comprising a bleach, which may be optionally dosed for a hygiene wash, suitably when the fabric is white.

The further ingredients may also be used to top up ingredients that may be present in the detergent formulation to provide a boost effect.

In a further aspect, the invention provides a dispensing device as described in the first aspect. It will be appreciated that all options and preferences previously described apply were permitted.

DESCRIPTION

The invention will now be described without limitation with reference to the following diagrammatical drawings in which.

Figure 1:
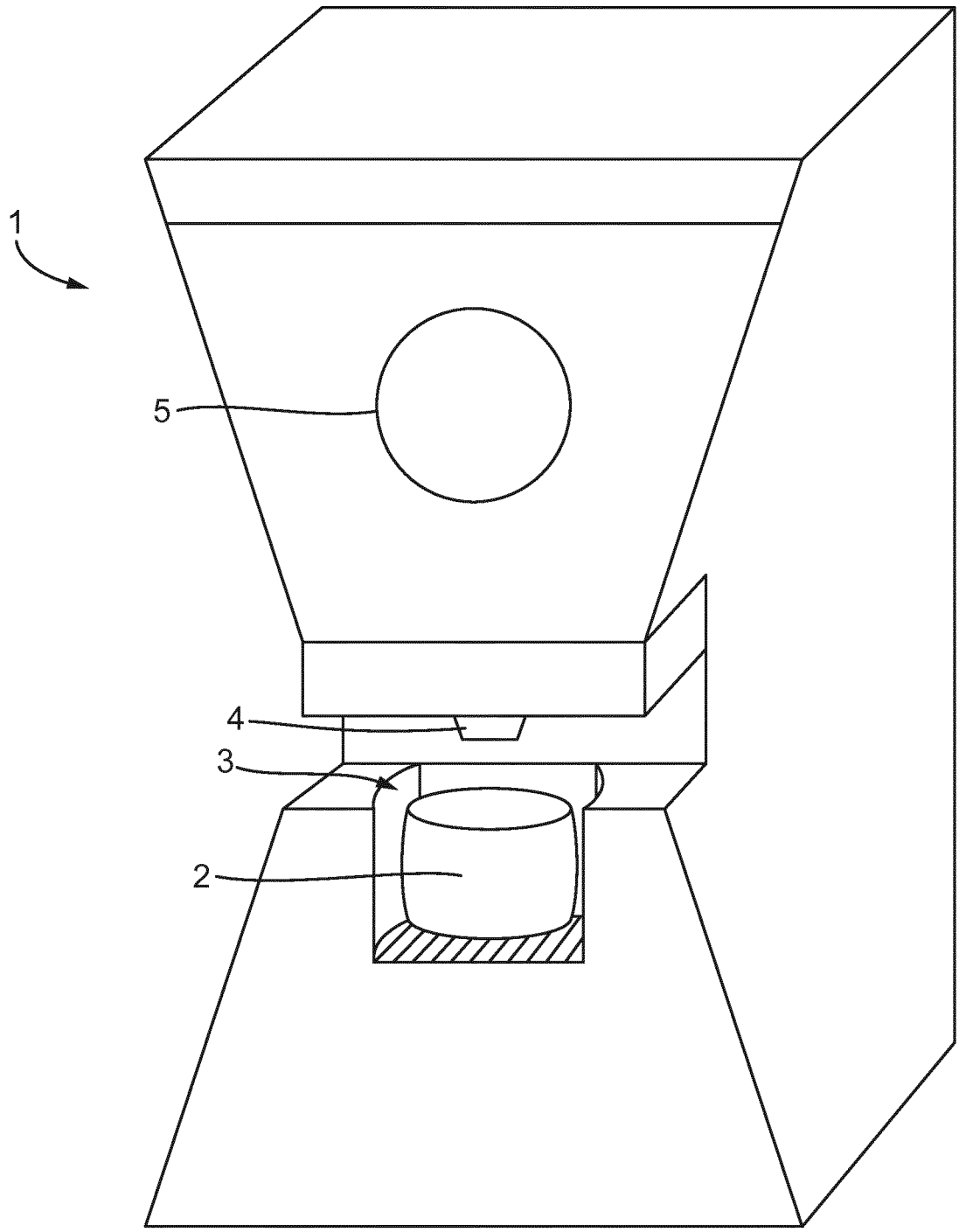
FIG. 1 shows a representative drawing of the apparatus of the invention.

The apparatus as illustrated in FIG. 1 has a dispensing device 1 and a dosing unit 2. The apparatus is a standalone device, designed to be placed on a countertop or similar. For example, it may be placed on a countertop in a kitchen or utility room, or may be placed on top of a washing machine. It may also be built into a kitchen unit.

As illustrated, the dosing unit is a conventional dosing ball, which is typically made of plastics material. In use, the dosing unit is placed in a dispensing area 3 located underneath a nozzle 4. As illustrated, the dispensing area 3 is a recess provided in the device housing, and the dosing unit 2 is placed on a surface provided in the housing. However, it will be appreciated that the housing may be shaped in different ways such that, for example, the dosing unit is placed directly on the countertop (or other surface on which the device is placed) in use.

Laundry product ingredients are dispensed into the dosing unit 2 via the nozzle 4. As shown, only one nozzle is used. However, it will be appreciated that more than one nozzle may be provided. For example, different reservoirs may be in fluid communication with different nozzles such that a first reservoir is in fluid communication with a first nozzle and a second reservoir is in fluid communication with a second nozzle.

The device has a control/information interface 5. As illustrated, the interface 5 is a touch screen provided in the housing that both displays information and allows selections and information to be inputted to a computer module (not shown).

However, in other embodiments the device may be provided with a panel having buttons, dials or similar for inputting information. In other embodiments, input may be conveyed via command or gesture. It will be appreciated that a display screen in the housing of the device is not essential. The device may be configured for use without a display screen, or an external display screen on for example a phone or tablet may be coupled to the device (for example, via Bluetooth or similar).

Figure 2:
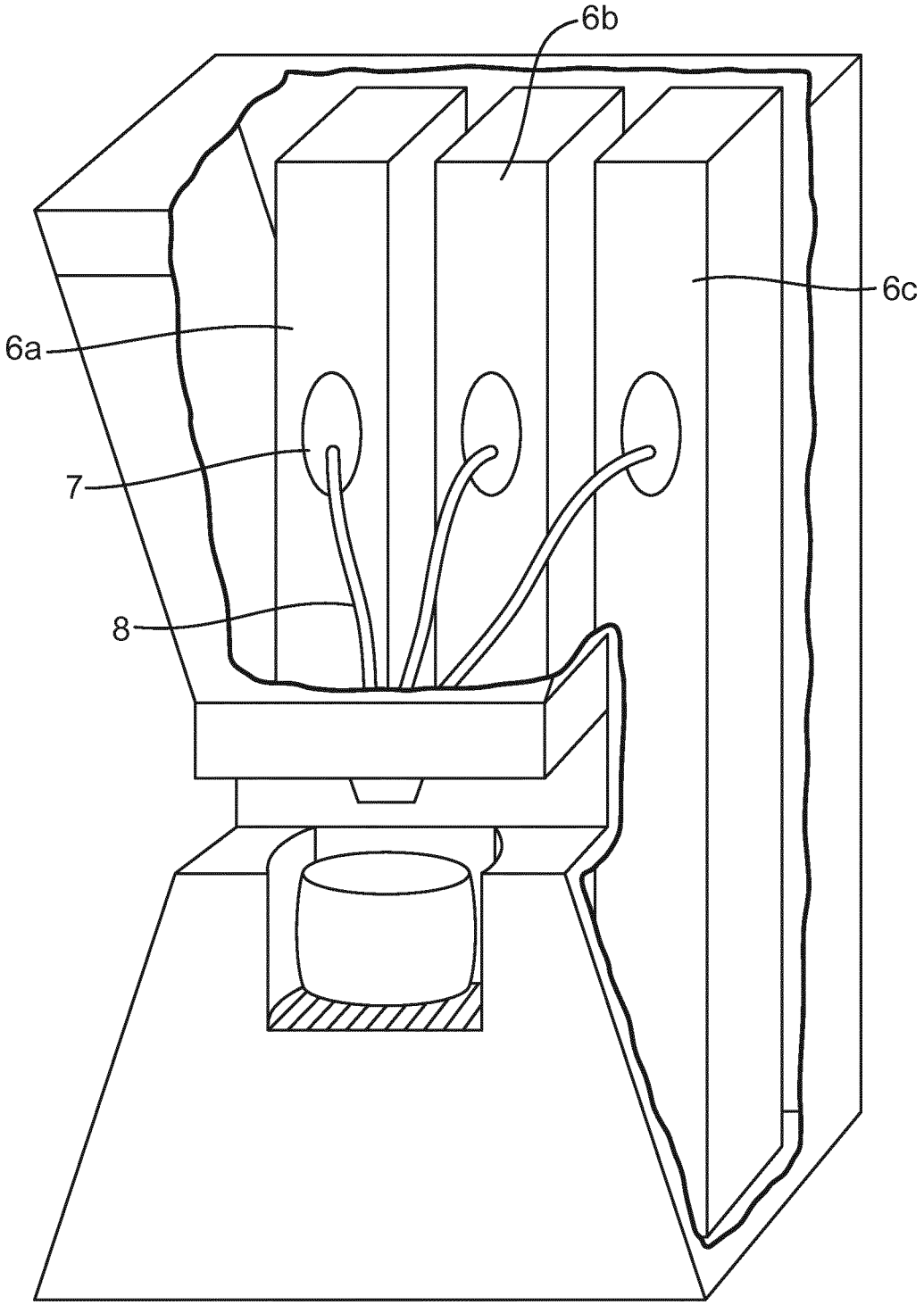
FIG. 2 shows a partially cut away representative drawing of the apparatus of the invention showing part of the cartridge arrangement.

FIG. 2 shows a partially cutaway image of the apparatus of FIG. 1. The interior houses three reservoir cartridges 6*a*, 6*b*, and 6*c*. Each cartridge houses an ingredient composition. For example, in this non-limiting illustrated embodiment, 6*a* houses a detergent formulation, 6*b* houses an enzyme formulation, and 6*c* houses a whitening composition (which may include a shading dye or similar). Each cartridge has a valve 7. Each cartridge is in fluid communication with the nozzle via a flow path 8. Flow from the cartridge to the nozzle (where it is dispensed) is controlled by the valve. In this embodiment therefore each valve is a metering valve, with the volume metered controlled by the computer module. It will be appreciated that the valves may be located at any point along the flow path, and other types of valve may be used. It will also be appreciated that metering of the ingredient compositions may be achieved in other ways, for example through generation of pressure in the reservoir to force the liquid out.

The diagram shows individual flows running from each reservoir to the nozzle 4. It will be appreciated that flow paths may meet before the nozzle is reached. For example, the device may have a pre-mixing chamber in which different ingredient compositions meet before they are dispensed into the dosing unit.

In use, the dosing unit is located under the nozzle (such that product dispensed through the nozzle enters a chamber of the doing device). The user inputs information about the laundry load to the computer module. Typically, data may be entered in two or more sets, each set requiring certain information from the user. For example, Set I may be used to input the load type: whites or colours. Set II may be used to input the presence or absence of staining and, optionally, the stain type. The user may therefore select whites, grass stains, mud stains. Other data requirements may include the fabric type (cotton/polycotton/polyester) as optimal fabric care benefit agents and amounts may be different in each case; fragrance selection (different members of the household may prefer different fragrances for their clothing, or it may be desirable to fragrance bedding and towels but not clothes); extent of staining (for example, lots of grass stains, only light mud stains); size of load (small loads may require less product).

An optimised wash composition is then determined and the appropriate amount from relevant cartridges dispensed. The computer module (not shown) controls the amount dispensed.

The recipe used to determine the amounts may be obtained from an internal memory within the device, or may be obtained from an external memory accessed, for example, via the internet. Often, particularly where there is more than one stain type, an algorithm may be employed to determine the optimised formulation, balancing the cleaning needs of certain stains against others.

In the apparatus as illustrated, 6*a* houses a detergent formulation, 6*b* houses an enzyme formulation, and 6*c* houses a whitening composition. Accordingly, if the user selects:

1. Colours→Not stained: the computer module may not dose the contents of 6*b* and 6*c* as the memory bank or algorithm may determine they are unnecessary.
2. Whites→Stained: the computer module may dose the contents of all three cartridges as the memory bank or algorithm may determine they are desirable.
3. Whites→Not stained: the computer module may not dose the contents of 6*b* as the memory bank or algorithm may determine it is unnecessary but may dose the contents of 6*c* as the memory bank or algorithm may determine it is desirable.
4. Colours stained: the computer module may not dose the contents of 6*c* as the memory bank or algorithm may determine it better for fabric care, but may dose the contents of 6*b* as the memory bank or algorithm may determine it is desirable.

Detergent Formulation

Also referred to as base formulation, this composition comprises one or more surfactants.

Example components for a concentrated detergent base include the following:

Anionic surfactants, for example having an anion selected from linear alkyl benzene sulfonate (LAS), primary alkyl sulfate (PAS), alkyl ether sulfate (AES) and mixtures thereof.

Nonionic surfactants, for example which may include primary and secondary alcohol ethoxylates, especially $C_8$-$C_{20}$ aliphatic alcohol ethoxylated with an average of from 1 to 20 moles of ethylene oxide per mole of alcohol, and more especially the $C_{10}$-$C_{15}$ primary and secondary aliphatic alcohols ethoxylated with an average of from 1 to 10 moles of ethylene oxide per mole of alcohol. Non-ethoxylated nonionic surfactants include alkyl polyglycosides, glycerol monoethers and polyhydroxy amides (glucamide). Mixtures of nonionic surfactant may be used.

Amine Oxide Surfactants of formula $R^1N(O)(CH_2R^2)_2$ in which $R^1$ is a long chain moiety and each $CH_2R^2$ is a short chain moiety. $R^2$ is preferably selected from hydrogen, methyl and —$CH_2OH$. In general $R^1$ is a primary or branched hydrocarbyl moiety which can be saturated or unsaturated, preferably, $R^1$ is a primary alkyl moiety having chain length of from about 8 to about 18 and $R^2$ is H. These amine oxides are illustrated by $C_{12-14}$ alkyldimethyl amine oxide, hexadecyl dimethylamine oxide, octadecylamine oxide.

Some zwitterionic surfactant, such as sulphobetaine, may be present. A preferred zwitterionic material is a betaine available from Huntsman under the name Empigen® BB.

Preferably the compositions contain less than 10 wt %, more preferably less than 5 wt % zwitterionic surfactant.

Cationic Surfactants may be included, but are preferably substantially absent from the detergent formulation.

A particularly preferred surfactant system is provided by linear alkyl benzene sulfonate (LAS) and $C_{10}$-$C_{15}$ alcohol ethoxylated nonionic surfactant with 2 to 7 EO.

Further Reservoir Laundry Ingredient Compositions

The present invention enables individual ingredients of the laundry product to be segregated in different compositions. Any further reservoir of the device may contain any one of the follow non-limiting examples of suitable compositions.

A suitable laundry ingredient composition may comprise on or more enzymes. Suitable enzymes include for example, lipases, proteases, amylases, mannanases, cellulases, and pectate lyases.

While enzymes are powerful stain removers, for many wash loads some or all enzymes may be omitted. For example, different families of enzymes are effective against different classes of stain, and a large number of laundry loads are not stained at all. Including enzymes in each and every wash may therefore be wasteful.

The inventors have observed that certain enzymes cannot be stored in combination. For example, protease and lipase cannot usually be combined in a single liquid composition because as the protease may digest the lipase on storage. Similarly, protease may digest cellulase on storage in a liquid. However, lipase gives excellent benefits on removal of fats, while cellulase gives improved fabric treatment with colour preservation and pill removal and/or background whiteness benefit (depending on the cellulase used). This means that conventional laundry projects often contain an enzyme mix.

The present invention permits, through use of more than one laundry enzyme ingredient composition, the assorted benefits of these enzymes to be accessed in a single load.

For example, the device may comprise a first further reservoir containing a first ingredient composition comprising a protease (and suitably not containing a cellulase and/or a lipase) and a second further reservoir containing a second ingredient composition comprising a cellulase and/or a lipase (and suitably not containing a protease). Neither, one or both of these compositions may then be supplied depending on, for example, the type of staining.

Accordingly, in some embodiments, the device has a further reservoir containing an ingredient composition comprising a protease. Additionally or alternatively, the device may comprise a further reservoir containing an ingredient composition comprising a cellulase and/or a lipase.

In some embodiments, the device may comprise a further reservoir containing an ingredient composition comprising a bleach. This may be optionally dosed for white loads.

The further ingredients may also be used to top up ingredients that may be present in the base formulation to provide a boost effect. For example, the applicant has observed large benefits for adding extra sequestrant into the wash cycle, over and above the amounts typically able to be formulated in laundry liquid formulations. The present invention enables the use of larger quantities of sequestrant than would normally be accessible by providing all or additional sequestrant in a separate reservoir to be dosed separately into the formulation provided in the dosing unit. Furthermore, the applicant has observed that the apparent benefits of greater sequestrant content are improved at lower pH. It will be appreciated that the present invention permits the provision of multiple liquid compositions, each having a different pH for storage, combined shortly before a wash begins.

In some embodiments, the device may comprise at least one further reservoir containing a fragrance composition. This offers two advantages: firstly, the user may select the fragrance to suit (for example, fresh, floral or musky) rather than being constrained by the sometimes limited options for certain laundry liquid products, and secondly, may optionally chose an unperfumed wash according to inclination.

Advantages of the Present Invention

1. Active ingredients and benefit agents are dosed only as needed wanted, reducing waste and environmental impact. This may also improve the appearance and longevity of garments.
2. Each wash can be tailored to specific needs for different types and load and for different family members, including:
   selective non-biological washes
   hygiene washes for babies, pets and elderly relatives
   garment care refresh washes for adult work wear
   tough stain removal for kids' clothes and sportswear
   fragrance free washes according to preference
   optionally, the invention may include the facility to store preferred formulations for user-defined groupings such as "bedding", "school uniform", "nursery".
3. In addition to "general" wash categories listed at point 2, each wash can be tailored to the specific type of stain(s), e.g. grass, beef fat, red wine.
4. Incompatible ingredients can be stored separately, and combined only in the wash liquor. Exemplary incompatible ingredient combinations are described herein.
5. Combinations of, and relative ratios of, ingredients can be used that are outside the normal limits of liquid laundry composition stability.

It is to be understood that the examples and embodiments described herein are for illustrative purposes and that various modifications or changes in light thereof will be suggested to a person skilled in the art and are included in the spirit and scope of the invention and the appended claims.

The invention claimed is:

1. An apparatus for providing laundry product comprising:
- a dosing unit configured to be placed in a washing machine drum and
- a dispensing device having a first reservoir containing a detergent composition and a further reservoir containing an ingredient composition;
  - wherein the device has a computer module programmed configured to cause the device to dispense the detergent composition and optionally the ingredient composition to provide a laundry product in the dosing unit as a result of input by a user,
  - wherein the device is configured to communicate with a user interface whereby the user is able to input data using at least two sets of options to provide user input, and
  - wherein the at least two sets of options are configured to prompt the user to input stain identity.

2. The apparatus of claim 1 wherein the device comprises at least three reservoirs, wherein each reservoir contains a different composition; optionally wherein the device comprises at least four reservoirs.

3. The apparatus of claim 1 wherein at least one set of options prompts the user to input fabric colour and/or type.

4. The apparatus of claim 1 wherein the computer module is programmed with an algorithm to select how much product is dosed from each reservoir based on the user input.

5. The apparatus of claim 1 wherein the computer module is programmed to communicate with an external source to access an algorithm and determine how much product is dosed from each reservoir based on the user input.

6. The apparatus of claim 1 wherein the device has a further reservoir containing a composition comprising an enzyme.

7. The apparatus of claim 1 wherein the device has a further reservoir containing a composition containing a protease and a second further reservoir containing a lipase and/or a cellulase.

8. The apparatus of claim 1 wherein the device has a further reservoir containing a composition comprising a fluorescer and/or a shading dye.

9. The apparatus of claim 1 wherein the device has a further reservoir containing a composition comprising a disinfectant.

10. The apparatus of claim 1, wherein the apparatus is a dispensing device for a washing machine.

11. A dispensing device comprising:

a first reservoir containing a detergent composition, and a further reservoir containing an ingredient composition;

wherein the device has a computer module programmed to cause the device to dispense the detergent composition and optionally the ingredient composition to provide a laundry product in a dosing unit as a result of input by a user, wherein the device is configured to communicate with a user interface whereby the user is able to input data using at least two sets of options to provide user input, and wherein the at least two sets of options are configured to prompts the user to input stain identity.

* * * * *